United States Patent [19]

Puder

[11] Patent Number: 4,831,681

[45] Date of Patent: May 23, 1989

[54] SPONGE SUPPORTING DEVICE WITH GUIDE ROD SPRINGS

[76] Inventor: Zeev Puder, 75-59 180 St., Flushing, N.Y. 11366

[21] Appl. No.: 25,597

[22] Filed: Mar. 13, 1987

[51] Int. Cl.[4] ..... A47K 5/08

[52] U.S. Cl. ..... 15/257.05; 108/136; 206/77.1; 248/218.4

[58] Field of Search ..... 206/77.1, 204, 209, 206/210; 15/257.05, 244 R, 244 C; 248/218.4, 507, 509; 108/24, 136; 211/51; 312/71

[56] References Cited

U.S. PATENT DOCUMENTS

| | | | |
|---|---|---|---|
| 2,289,514 | 7/1942 | Mastney et al. | 108/136 |
| 2,529,639 | 11/1950 | Sterzer | 248/161 |
| 2,994,901 | 8/1961 | Ely | 15/257.05 |

FOREIGN PATENT DOCUMENTS

| | | | |
|---|---|---|---|
| 197358 | 5/1907 | Fed. Rep. of Germany | 15/257.05 |
| 577800 | 6/1933 | Fed. Rep. of Germany | 206/77.1 |
| 179786 | 9/1935 | Switzerland | 15/257.05 |
| 698315 | 10/1953 | United Kingdom | 15/257.05 |

*Primary Examiner*—Stephen Marcus
*Assistant Examiner*—Bryon Gehman
*Attorney, Agent, or Firm*—Ilya Zborovsky

[57] ABSTRACT

A device for supporting a sponge has a container filled with liquid, a sponge supporting plate in the container, and a resilient member urging the supporting plate with the sponge away from the liquid and depressable by a user into the liquid to moisten the sponge.

4 Claims, 1 Drawing Sheet

SPONGE SUPPORTING DEVICE WITH GUIDE ROD SPRINGS

BACKGROUND OF THE INVENTION

The present invention relates to a device for supporting a sponge.

Sponges are widely used in households and industrial places . Before use, the sponge has to be moistened (wetted) with a liquid , such as water, solution, soap water, liquid detergent etc. Sponges are usually held on rigid supports, and for moistening removed from the supports and soaked into respective reservoirs with the above listed media. Then after use they are again placed back onto supports. Such operations are inconvenient and time consuming. Moreover, the liquid consumption is increased because of liquid dripping during the sponge removal from and placement onto the stationary supports of rigid nature.

SUMMARY OF THE INVENTION

Accordingly, it is an object of the present invention to provide a supporting device for a sponge which avoids the disadvantages of the prior art.

In keeping with these objects and with others which will become apparent hereinafter, one feature of the present invention resides, briefly stated, in a device with a container fillable with a liquid, a perforated supporting plate which supports a sponge , and a resilient means which resist lowering the supporting plate and keeps the sponge not soaked with the liquid, and at the same time the resistance of the resilient means can be overcome by a user and the sponge can be dipped into the liquid by lowering of the supporting plate.

When the device is designed in accordance with the present invention , it avoids the above listed disadvantages.

The novel features of the invention are set forth in particular in the appended claims. The invention itself however will be best understood from the following description of preferred embodiments which is accompanied by the following drawings.

DESCRIPTION OF A PREFERRED EMBODIMENT

Figure 1:
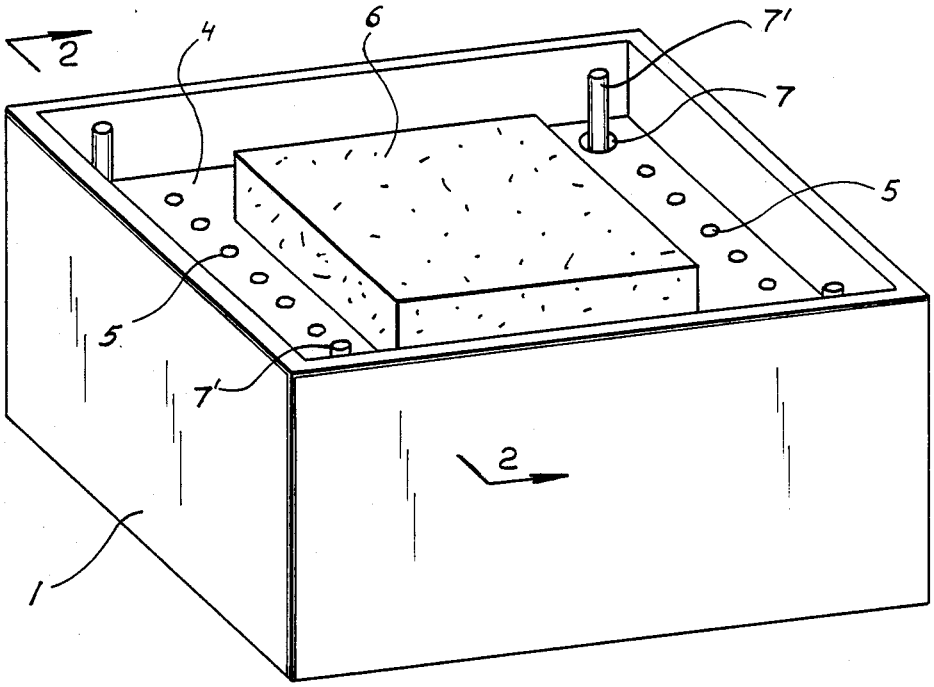
FIG. 1 is a perspective view of a device for supporting a sponge in accordance with the present invention.

A device for supporting a sponge includes a container which is identified as a whole with reference numeral 1. The container 1 has a bottom wall 2 and a vertical peripheral wall 3. The container 1 can be filled with a desired liquid , such as water, a solution of washing powder, a liquid detergent etc.

The device further has a supporting plate which is identified as a whole with reference numeral 4. The supporting plate has a plurality of perforations 5 and an upper surface arranged to support a sponge 6. The supporting plate 4 also has guiding openings 7.

Guiding rods or pins 7' extend from the bottom 2 of the container 1 upwardly and end shortly before an upper edge 8 of the peripheral wall of the container. Pressure springs 9 are arranged on the guiding rods 7'.

Figure 2:
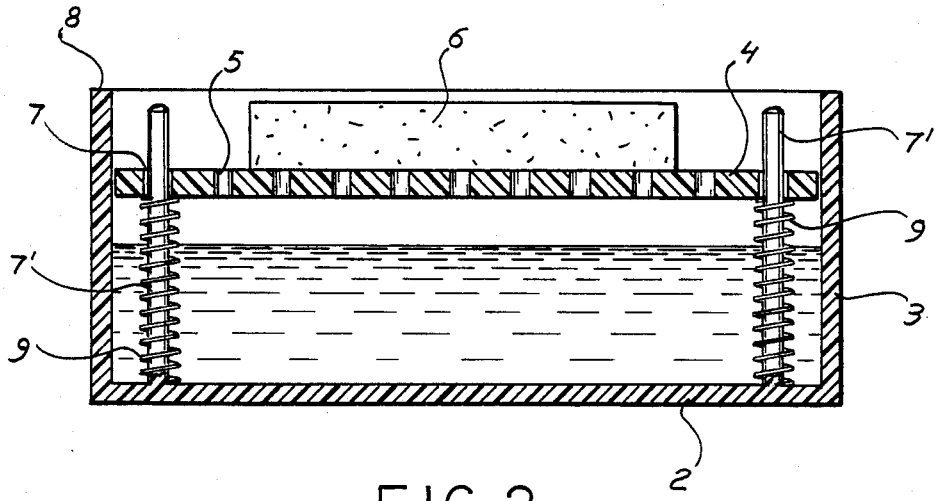
FIG. 2 is a view showing a cross section of the inventive device for supporting a sponge, taken along the line I—I in FIG. 1.

As can be seen from FIG. 2 , the guiding rods 7' can be made of one piece with the bottom 2 of the container 1, for example by molding from a synthetic plastic material. This considerably facilitates the manufacture of the device.

The device for supporting a sponge in accordance with the present invention operates in the following manner:

The sponge 6 is placed on the supporting plate 4 which is inserted into the container 1 filled with a liquid. The springs 9 retain the supporting plate 4 with the sponge 6 at a level which is higher than the level of liquid in the container 1 and below the edge 8 of the container 1. For using a wet sponge, a user presses the supporting plate 4, for example, by a finger, downwardly below the level of liquid, liquid penetrates through the perforations 5 of the supporting plate 4 and moistens the sponge 5. The guiding rods 7' guide the supporting plate during its upward and downward movement. When the supporting plate 4 and the peripheral wall of the container 1 have the same contour, for example a rectangular contour as shown in FIG. 1, the plate 4 is additionally guided inside the peripheral wall by its inner surfaces.

The invention is not limited to the details shown since various modifications and structural changes are possible without departing from the spirit of the invention.

What is desired to be protected by Letters Patent is set forth in particular in the appended claims.

I claim:

1. A device for supporting a sponge, comprising a container arranged to be filled with a liquid and having a peripheral wall, a bottom having an upper surface, and a plurality of guiding rods extending vertically upwardly from said upper surface of said bottom and being unitary with said bottom, each said guiding rod being spaced inwardly from said peripheral wall so as to form a narrow gap therebetween;

a supporting plate having an upper surface arranged to support a sponge and being provided with guiding openings through which said guiding rods slidingly pass and also being provided with a plurality of perforations through which said liquid can pass, said supporting plate having a lower surface facing toward said upper surface of said bottom; and a plurality of springs urging said supporting plate upwardly from said liquid accommodated in said container so that in normal condition said liquid does not pass through the perforations and does not moisten the sponge, while when said urging is overcome by a user by pressing said supporting plate downwardly said liquid passes through said perforations and moistens the sponge, each of said springs having first and second ends and being fitted on a respective one of said guiding rods so that said first end abuts against a lower surface of said supporting plate and said second end abuts against said upper surface of said bottom while a peripheral portion of each of said springs is accommodated in a respective one of said gaps between a respective one of said one piece guiding rods and said peripheral wall of said container.

2. A device as defined in claim 1, wherein said peripheral wall of said container has an inner contour, said supporting plate having an outer contour substantially corresponding to said inner contour of said peripheral wall so that said supporting plate is movable upwardly and downwardly being substantially guided by said inner contour of said peripheral wall.

3. A device as defined in claim 2, wherein said inner contour of said peripheral wall and said outer contour of said supporting plate are rectangular.

4. A device as defined in claim 3, wherein said container has corners, said supporting plate also having corners, said guiding rods being arranged in the region of said corners of said container, said guiding openings being provided in the region of said corners of said supporting plate.

* * * * *